US006199858B1

(12) United States Patent
Wyer

(10) Patent No.: US 6,199,858 B1
(45) Date of Patent: Mar. 13, 2001

(54) OFFICE PRINTING APPARATUS WITH SHINGLING OF SHEETS IN A DUPLEX LOOP

(75) Inventor: Andrew F. Wyer, Comberton (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/337,477

(22) Filed: Jun. 21, 1999

(30) Foreign Application Priority Data

Jun. 26, 1998 (GB) ..... 9813931

(51) Int. Cl.[7] ..... B65H 29/00

(52) U.S. Cl. ..... 271/186; 271/216; 271/266; 271/202; 271/151; 271/185; 271/3.15

(58) Field of Search ..... 271/3.15, 186, 271/185, 216, 151, 266, 202

(56) References Cited

U.S. PATENT DOCUMENTS 5,088,711 * 2/1992 Newsome ..... 270/52.14
5,842,696 * 12/1998 Haan et al. ..... 271/225

* cited by examiner

*Primary Examiner*—Donald P. Walsh
*Assistant Examiner*—Jonathan R. Miller
(74) *Attorney, Agent, or Firm*—R. Hutter

(57) ABSTRACT

Apparatus for stacking sheets comprises a duplex tray for holding a sheet in a temporary storage position. A dispense nip is formed at an outlet of the tray. Rollers feed a sheet from the temporary storage position by a predetermined distance through the dispense nip. Any sheets already located in the dispense nip are fed at the same time by substantially the same predetermined distance, whereby a shingled stack of sheets is obtained.

6 Claims, 3 Drawing Sheets

OFFICE PRINTING APPARATUS WITH SHINGLING OF SHEETS IN A DUPLEX LOOP

FIELD OF THE INVENTION

The invention relates to a method and apparatus for stacking sheets, for example for use in reproduction apparatus such as electrostatic reproduction apparatus.

BACKGROUND OF THE INVENTION

There are many applications in which sheets must be fed singly from a stack to a downstream position. One important application is in reproduction apparatus such as electrostatic reproduction apparatus in which blank sheets are held in a stack and then fed singly through the apparatus to a reproduction station where an image is transferred onto the sheet, the sheet then being fed on to an outlet. A further example is a duplex tray within reproduction apparatus for use when images are to be reproduced on both sides of the sheet. In this situation, a blank sheet is fed to the reproduction station so that an image can be reproduced on one side of the sheet, the sheet then being fed to a temporary storage location defined by a duplex tray where the sheet can be flipped in its orientation and then drawn out and fed back through the reproduction station so that a further image can be reproduced on its other side.

In all applications where sheets are to be fed singly from a stack, it is important to prevent more than one sheet being fed simultaneously. Conventionally, this is achieved by using counter running rolls or nips and the like.

SUMMARY OF THE INVENTION

In accordance with one aspect of the present invention, there is provided an apparatus for feeding sheets, comprising a belt transport, defining a surface movable in a process direction. A first pair of rollers, defining a dispense nip, is disposed upstream of the belt transport in the process direction. A second pair of rollers, defining a feeder nip, is disposed downstream of the belt transport in the process direction. A control causes feeding of a leading edge of a first sheet a predetermined short distance through the dispense nip, and then feeds leading edges of each of a plurality of subsequent sheets a predetermined short distance through the dispense nip, thereby causing respective leading edges of the first sheet and subsequent sheets to be spaced by the predetermined short distance as the plurality of sheets are fed through the dispense nip and placed on the belt transport. The control further causes the rollers forming the feeder nip to draw a leading edge of a sheet when the leading edge of the sheet enters the feeder nip from the belt transport.

In this invention, a stack of sheets is generated in which the sheets are already shingled or overlap and are not exactly aligned. This then enables downstream feed systems to be considerably simplified since a simple feed roller or belt can be arranged to engage just the leading most sheet in the shingled stack without any danger of also engaging other sheets in the stack. Typically, the remaining sheets in the stack will be held relatively tightly while the leading most sheet is fed forward.

Conveniently, a sheet in the temporary storage position lies in a plane with a vertical component. This orientation reduces storage space requirements but also allows sheets to be delivered to the temporary storage position from above, in which case the method may comprise moving a trailing end of a sheet into alignment with the dispense nip. This movement can be a simple flipping of the sheet from one orientation to the other typically from, to or through a vertical orientation.

The method preferably comprises holding the sheet in the temporary storage position using a feed nip, the feed nip being activated to feed the sheet to the dispense nip. However, the temporary storage position may provide a simple fixed base against which sheets lodge with a separate feed system for feeding sheets to the dispense nip.

The dispense nip itself can be defined by one or more cooperating pairs of rollers, belts or any other conventional apparatus.

The amount of overlap can be chosen depending upon the application. Typically, a relative displacement of about 10 mm will be used although the displacement could be increased to 20 mm or more.

BRIEF DESCRIPTION OF THE DRAWINGS

An example of a method and apparatus according to the invention and reproduction apparatus incorporating the example will now be described with reference to the accompanying drawings, in which.

DETAILED DESCRIPTION OF THE INVENTION

Figure 1:
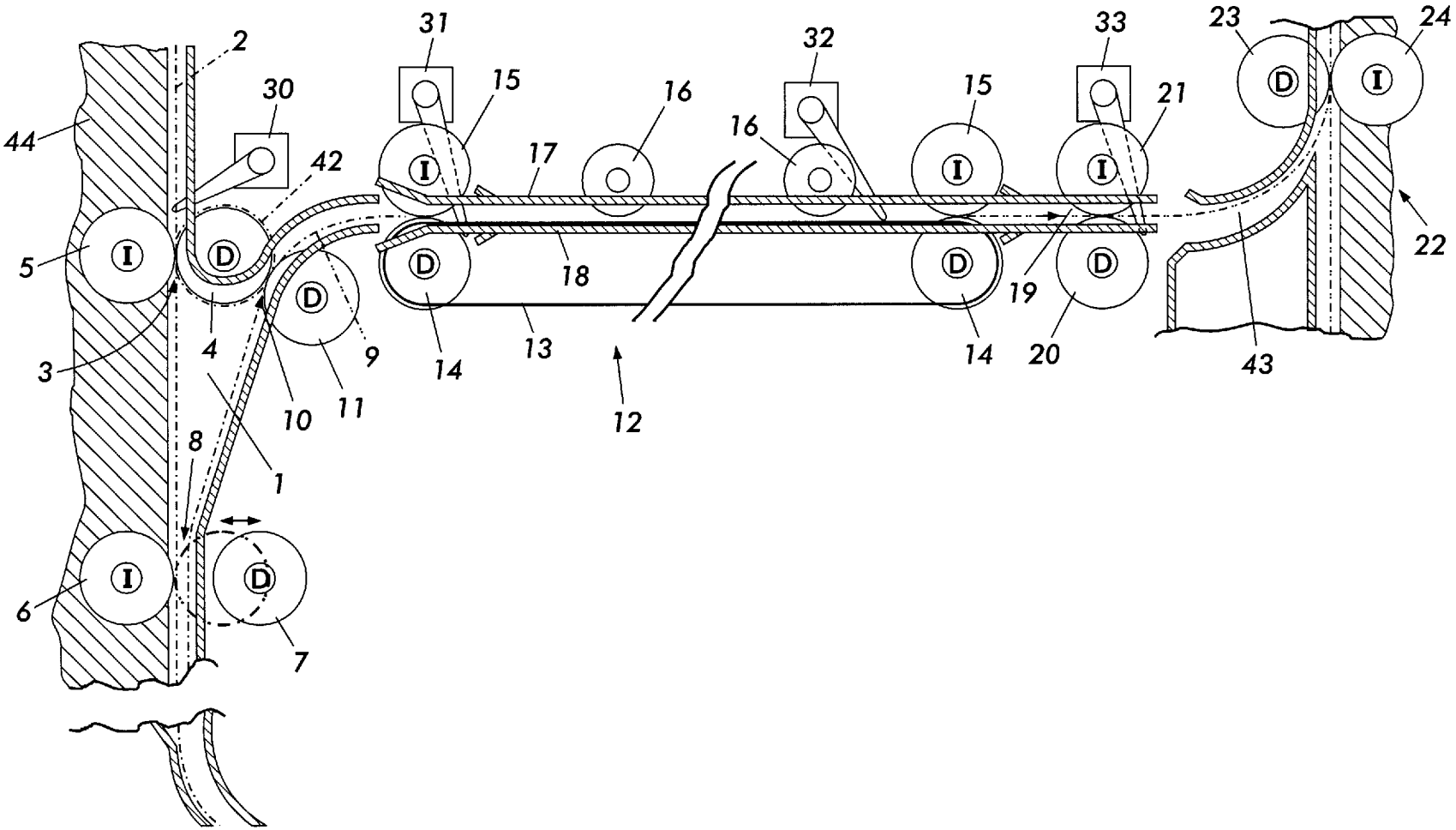
FIG. 1 is a schematic section through the stacking apparatus.

The apparatus shown in FIG. 1 comprises a duplex tray 1 of generally conventional form having an inlet 2 to which sheets are fed singly by conventional means (not shown) such as a belt transport. Incoming sheets are fed vertically into a transport nip 3 defined between a drive roller 4 and an idler roller 5. Towards the bottom of the duplex tray 1 are provided a further pair of idler and drive rollers 6, 7, the drive roller 7 being movable towards and away from the idler roller 6 and defining a nip 8 when the rollers are in contact. Typically, the drive roller 7 will be mounted on an arm which is actuated by a solenoid or the like (not shown).

The duplex tray 1 has an outlet 9 in which is located a dispense nip 10 defined by a drive roller 11 and an idler roller 42.

Downstream of the outlet 9 is a horizontal belt transport 12 formed by one or a number of laterally spaced belts 13 entrained around drive rollers 14, the rollers 14 cooperating with respective idler rollers 15 to define respective nips. Further idler rollers 16 are provided to assist with sheet guidance together with upper and lower guide plates 17, 18.

Downstream of the horizontal belt transport 12 is a feeder nip 19 defined between a drive roller 20 and an idler roller 21, sheets being fed from the nip 19 into a main transport, part of which is shown at 22 and which includes take-up drive and idler rollers 23, 24.

In order to monitor and control the passage of sheets through the apparatus shown in FIG. 1, a number of detectors and sensors are provided, all based on the use of microswitches. Of course, other types of detector based on radiation beams and the like could be used instead. These comprise a paper trailing edge detector 30 situated just upstream of the nip 3, a jam clearance sensor 31 located downstream of the dispense nip 10, a paper in tray sensor 32 for sensing the presence of sheets in the horizontal belt transport 12, and a paper in feeder sensor 33 just downstream of the nip 19.

Figure 2:
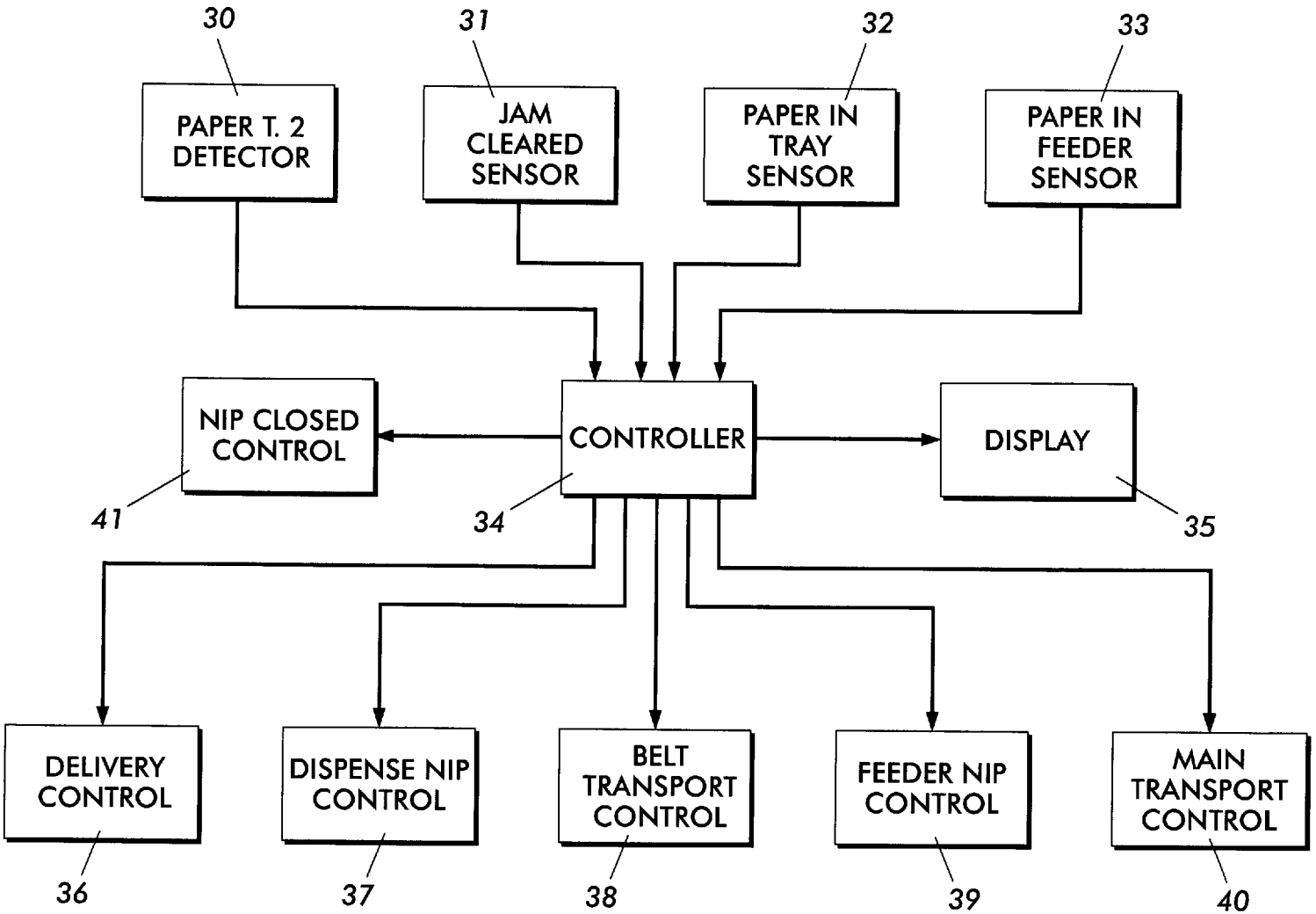
FIG. 2 is a block diagram of the control components for the apparatus shown in FIG. 1.

Each of the sensors is linked to a controller 34 (FIG. 2) in the form of a microprocessor, the controller being coupled to a display 35 and to a number of control mechanisms for selectable coupling the various drive rollers to a drive motor (not shown). The control mechanisms comprise a delivery controller 36 for controlling operation of the drive roller 4, a dispense nip controller 37 for controlling operation of the rollers 7, 11, a belt transport controller 38 for controlling operation of the rollers 14, a feeder nip controller 39 for controlling operation of the drive roller 20 and a main transport controller 40 for controlling operation of the roller 23. In addition, the controller 34 is connected to a nip closure controller 41 for controlling movement of the drive roller 7 towards and away from the idler roller 6. Of course, the controller 34 will be linked to other devices including an input device such as a keypad and the like and other controllers for controlling overall operation of the reproduction apparatus.

The operation of the apparatus shown in FIG. 1 will now be described. Initially, the drive roller 4 will be rotating to feed sheets downwardly into the duplex tray 1. This will occur after the sheet has been copied on its first side and passed through a post fuser transport. In this case, additional idler rollers 42 are provided on the same shaft as the drive roller 4 to impart corrugations to the incoming sheet. At this stage, the drive roller 7 is spaced from the idler roller 6 (as shown in solid lines in FIG. 1) in order to accommodate different lengths of sheet. As the trailing end of the incoming sheet is detected by the detector 30, the controller 41 is actuated to cause the drive roller 7 to engage the idler roller 6 so as to define a nip with the sheet extending into the nip. The timing is chosen such that once the sheet has been secured in the nip between the rollers 6, 7, the trailing edge has passed through the nip 3. However, the drive roller 4 continues to rotate so as to flip the trailing end of the sheet from the nip 3 into alignment with the nip 10.

The controller 37 is then actuated to cause the rollers 6, 7 and 42, 11 to feed the sheet through the dispense nip 10. This feeding operation is performed only for a short while so as, for example, to feed about 10 mm of the sheet through the dispense nip 10. With the sheet held stationary in the dispense nip 10, the nip 8 is opened to receive the next sheet which is fed vertically downwardly as before until it is gripped in the nip 8. The sheet edge is flipped into alignment with the dispense nip 10 so that the most recently received sheet rests on the previous sheet. The rollers 7, 11 are then actuated and this causes both sheets to be fed forward by about 10 mm. Since both sheets are fed together, the first sheet will maintain a 10 mm lead over the second sheet resulting in a shingled stack.

As the stack builds up, the shingled stack will gradually pass into the horizontal belt transport 12. At this stage, when no sheets are being withdrawn from the stack, the belt transport 12 will remain stationary. The presence of sheets in the horizontal belt transport 12 is detected by the sensor 32 and as the sheets are fed on, the leading sheet will pass into the nip 19 and this will be sensed by the sensor 33. At this point, the controller 34 prevents further feeding of the stack. The apparatus is now ready to feed sheets into the main transport. The controller 34 therefore actuates the drive roller 20 via the feeder nip control 39 and the belt 13 via the belt transport control 38 so as together to feed the leading sheet forward into a path 43 and then into the nip defined between the rollers 23, 24 for onward passage into the main transport. It will be appreciated that since the sheets in the stack are shingled, only a single sheet is present in the nip 19 50 that there is no danger of more than one sheet being fed. The remaining sheets in the stack are held primarily at their trailing end in the nip between the rollers 14, 15 just downstream of the nip 10.

Some coordination is necessary between the stacking process and the feed out process but this can easily be achieved using the controller 34. Furthermore, a variation in the number of sheets in the stack can be accommodated by varying the overlap distance. For example, a spacing of 20 mm between successive sheets could be used instead of 10 mm. The essential requirement is that the spacing between successive sheets is sufficient such that only a single sheet is present within the nip 19 at any one time.

If a jam occurs, this will be detected by the sensor 31. The jam can be cleared if the idler rolls 5, 6 are mounted on a side opening door 44 which can then simply be opened to gain access to the duplex tray 1. Further access can be gained by mounting the belt mechanism and feeder nip components 20, 21 in a tray between draw slides, the idler rolls 15, 16 opening in an upper guide hinged at the rear.

Figure 3:
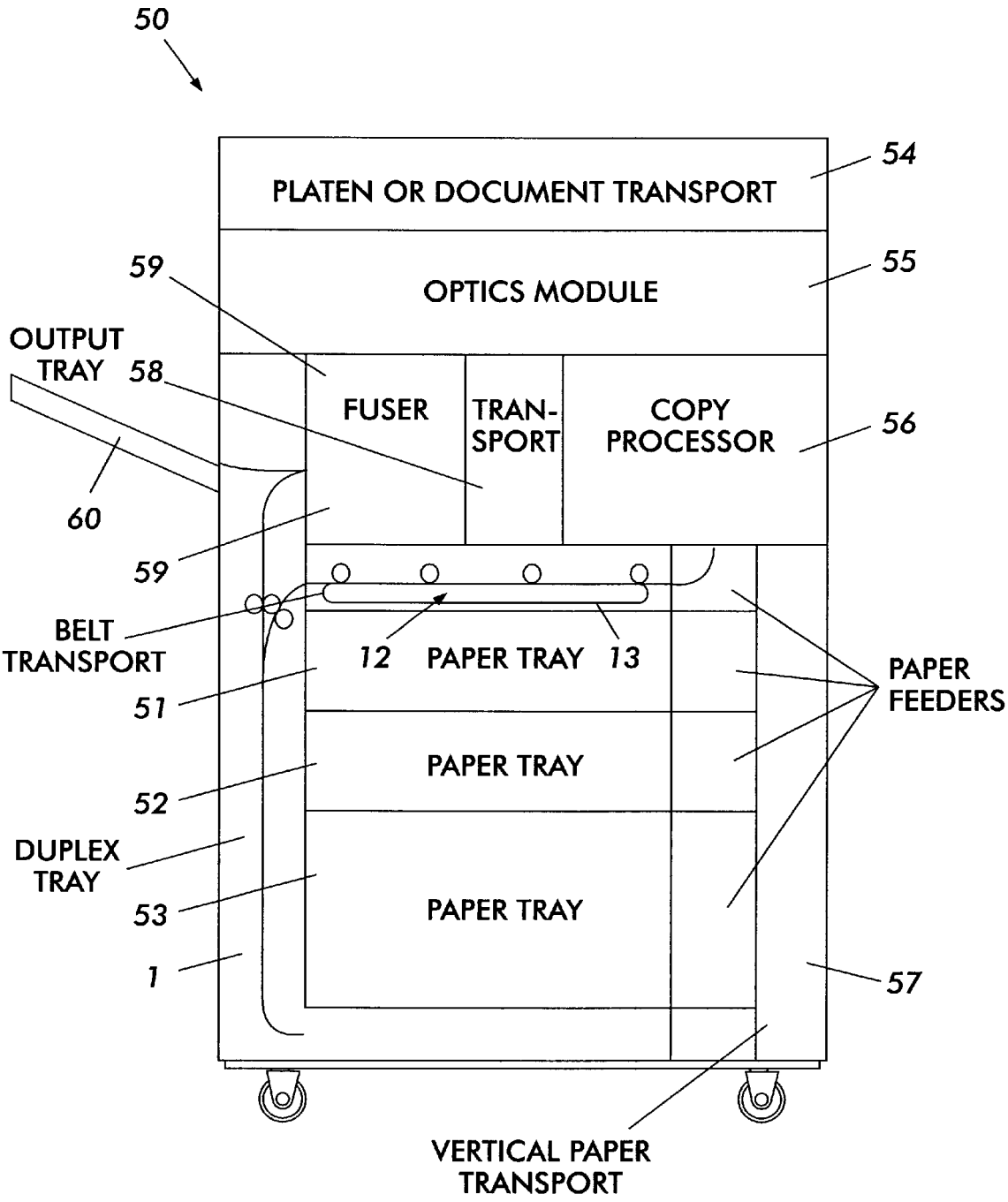
FIG. 3 illustrates schematically reproduction apparatus incorporating the apparatus of FIG. 1.

FIG. 3 illustrates the apparatus of FIG. 1 located within a xerographic copier 50. As can be seen, the belt 13 is located above a set of paper storage trays 51–53 with the duplex tray 1 positioned alongside the trays 51–53. When a document is to be copied, the original document is placed on a platen or document transport 54 and the image transferred by an optics module 55 to a copy processor module 56 where it is reproduced on a first side of a sheet of paper fed from one of the trays 51–53 by a vertical paper transport 57. The imaged paper sheet is fed by a transport 58 to a fuser station 59 to fuse the image and from there to the duplex tray 1. The sheet is then fed in a stacked manner with previous sheets as previously described through the belt transport 12 back to the copy processor 56 for imaging the second side which is then fed via the transport 58 to the fuser module 59 and then to an output tray 60.

What is claimed is:

1. A printing apparatus, comprising:

a marking device;

a belt transport, defining a surface movable in a process direction;

a first pair of rollers defining a dispense nip, disposed upstream of the belt transport in the process direction;

an inverting mechanism for accepting sheets from the marking device and inverting sheets before the sheets are fed through the dispense nip;

a second pair of rollers defining a feeder nip, disposed downstream of the belt transport in the process direction, the second pair of rollers being disposed to feed sheets to the marking device; and control means for causing feeding of a leading edge of a first sheet a predetermined short distance through the dispense nip, and then feeding leading edges of each of a plurality of subsequent sheets a predetermined short distance through the dispense nip, thereby causing respective leading edges of the first sheet and subsequent sheets to be spaced by the predetermined short distance as the plurality of sheets are fed through the dispense nip and placed on the belt transport;

the control means further causing the rollers forming the feeder nip to draw a leading edge of a sheet when the leading edge of the sheet enters the feeder nip from the belt transport.

2. The apparatus of claim 1, further comprising:

a sensor for detecting that the leading edge of the first sheet is disposed near the feeder nip; and wherein the control means stops causing feeding of subsequent sheets through the dispense nip when the leading edge of the first sheet is disposed near the feeder nip.

3. The apparatus of claim 1, wherein the predetermined short distance is not more than 20 mm.

4. The apparatus of claim 1, wherein the marking device outputs sheets to the inverting mechanism.

5. The printing apparatus of claim 1, wherein the inverting means causes a sheet fed therein to be disposed substantially vertically before feeding to the dispense nip.

6. The printing apparatus of claim 1, wherein the belt transport is disposed under the marking device.

* * * * *